US005347838A

United States Patent [19]

Matsuoka

[11] Patent Number: 5,347,838

[45] Date of Patent: Sep. 20, 1994

[54] FORMING DIE FOR THIN PLATE

[75] Inventor: Mitsuo Matsuoka, Hirakata, Japan

[73] Assignee: Umix Co., Ltd., Osaka Prefecture, Japan

[21] Appl. No.: 81,129

[22] Filed: Jun. 25, 1993

[51] Int. Cl.[5] ..... B21D 5/04

[52] U.S. Cl. ..... 72/313; 72/452

[58] Field of Search ..... 72/312–315, 72/411, 452

[56] References Cited

U.S. PATENT DOCUMENTS

| | | | |
|---|---|---|---|
| 1,183,523 | 5/1916 | Bauroth | 72/315 |
| 1,408,787 | 3/1922 | Weaver | 72/313 |
| 1,858,047 | 5/1932 | Ireland | 72/312 |

FOREIGN PATENT DOCUMENTS

| | | | |
|---|---|---|---|
| 59-110427 | 6/1984 | Japan | 72/313 |
| 63-41652 | 8/1988 | Japan . | |
| 631902 | 11/1949 | United Kingdom | 72/313 |

*Primary Examiner*—Daniel C. Crane

*Attorney, Agent, or Firm*—Birch, Stewart, Kolasch & Birch

[57] ABSTRACT

A method is disclosed of forming a thin plate having a negative angle-formed portion when a second die is moved straight to bump against a first die to form a work, when the first die is rotatably provided with a rotary cam having a negative angle forming portion, and the second die is equipped with a slide cam having a negative angle forming portion in its opposite position to said rotary cam, and the second die is so set to approach the first die, then the slide cam bumps against the rotary cam and moves to form a negative angle-forming portion between both cams, and after negative angle forming portions having been made, the second die withdraws from the first die and the rotary cam is made to rotate and retreat to the extent that the work can be taken out from the first die. In such a forming method, the negative angle forming portion of the bent work is divided into plural portions which are substantially straight within a range capable of processing with one rotary cam.

2 Claims, 10 Drawing Sheets

FORMING DIE FOR THIN PLATE

BACKGROUND OF THE INVENTION

1. Field of the Invention

The present invention relates to a method of forming a thin plate and its forming die.

2. Description of Related Art

Negative angle forming of a thin plate such as a sheet metal or a plastic plate is performed using a slide cam. In the meantime, the aforementioned "negative angle forming" means such forming which produces a formed portion that enters a lower die from a working locus of an upper die when a work placed on the lower die is formed by pressing with the upper die vertically going down. Conventional negative angle forming processing for thin plate products was performed in such a way that a work is placed on the lower die, and the upper die is made to go down vertically to drive a lower die receiving cam by an upper die actuation cam, and the work is processed from the direction of its side. When processing finishes and the upper die rises, the receiving cam is withdrawn by a spring. In this case, the forming portion of the receiving cam which slides in from a position apart from a transversal outside of the work and forms the work is formed into the same and integrated shape as that of the forming portion of the work. However, the forming portion of the lower die to be loaded with the work must be taken out from the lower die after processing the work, thus the negative angle portion of the lower die is divided to withdraw or the back of the negative angle portion is cut and the work must be moved forward to enable the work to be taken out. When a negative angle is small, there is almost no problem. However, when a negative angle is large, or the product has a long and narrow frame shape with a section of a slot, for example, a front pillar outer of an automobile's sheet metal parts, if the negative angle portion of the lower die is divided or cut, a clear shape not only can not be formed on the forming portion of the receiving cam because of the narrow slot width of the work, but also the negative angle forming processing was impossible because of insufficient strength of the lower die. Moreover, the negative angle forming by a slide cam is performed by sliding a receiving cam over a considerably long straight distance, thus it is not necessarily easy to repetitively slide the receiving cam to a predetermined position, therefore it is difficult to obtain products of stabilized quality. Still furthermore, torsion or deformation arises in the products and sometimes it is required to repair the products, however parts constituting an automobile's shell plate portion such as a side panel, front fender, roof, hood, trunk lid door panel and front pillar outer, all of them have three-dimensional curved surfaces and curves, and thus repairing these products is practically impossible. In the case of an automobile's sheet metal assembly, if there is torsion or deformation in parts, these parts are difficult to connect with other parts, and thus an automobile's sheet metal structure of high quality could not be supplied, therefore it was impossible to maintain predetermined accuracy of thin plate forming parts. Furthermore, use of the slide cam necessitated equipping a large receiving cam or a heel on a side of the lower die load with a work, thereby increasing the area of the lower die, that is, the weight of the die, and also resulting in an expensive die.

Then, in order to solve the above problems, the present applicant has already proposed, in patent publication SHO 63 (1988)-41662, a method of forming a thin plate and its forming die in which vertical linear motion of a press is converted into revolution.

First, the forming die is explained with reference to FIGS. 6–10.

FIG. 6 is a schematic perspective view showing finished right and left parts of front pillar outer of automobile sheet metal parts formed by the present forming die. In FIG. 6, a part shown below is for right side use and a part shown above is for left side use. The front pillar outer is a part of a front door frame and also a part of a front glass frame and furthermore a part of a roof panel supporting frame. Therefore, it has a number of connections with many parts and a product which is required to have severe accuracy and when its accuracy is not attained, a sheet metal body of good quality can not be obtained. In addition, this front pillar outer has three-dimensional curved surfaces and curves. Portions to be negative angle formed by the present forming die are shown with characters F in FIG. 6, and the section of the portion is shown as a work W in FIG. 10. That is, a state of the work W shown in FIG. 7 becomes a state of the work W shown in FIG. 10. In this connection, in processes of this press working, first drawing is performed, next outer peripheral trimming is effected to the extent shown in FIG. 7, and then the present forming process is carried out as the third process.

A lower die 100 is provided with, rotatably in a lower die body 103, a cylindrical rotary cam 102 having a slot 101 engraved in the direction of its axis. The lower die body 103 is fixed on a lower base 121 with a bolt 122. The top face of the lower die body 103 is formed into a shape capable of placing a work W, and a negative angle forming portion 104 is formed on the slot 101 edge portion of the rotary cam 102 near the top face of the lower die body 103. An automatic return device 105 which rotates and withdraws the rotary cam 102 so as to take out the work W from the lower die body 103 after forming it is buried in the lower die body 103. In this embodiment, the automatic return device 105 makes a push pin 107, which is activated by a coil spring 106, contact an end bottom face of a rotary plate 108 which is fixed with a bolt 151 to a face opposed to the negative angle forming portion 104 of the slot 101 of the rotary cam 102. In addition, as an automatic return device 105, a pneumatic system, hydraulic system, link mechanism, cam or the like can be used, and the device can be provided between the upper and the lower dies 109 and 100 as well as in the lower die 100.

The upper die 109 is provided with a slide cam 110 in a position opposed to the rotary cam 102. This slide cam 110 is provided with a negative angle forming portion 112 at its bottom end. The slide cam 110 is guided by a guide (not shown) and activated toward an outside of the die by a coil spring 117 compressed between the top face of the slide cam 110 and a bottom face of an inclined guide 154 fixed to an upper base 152 with a bolt 153. The slide cam 110 is stopped by a stop plate 156 fixed with a bolt 155 to the inclined guide 154. A pad 157 is activated downward by a coil spring 158 and is hanged from the upper base 152 by a hanging bolt 110 and pushes the work W strongly against the lower die body 103 so as not to move the work W before negative angle forming of the work W.

Next, the performance of this forming die will be described.

As shown in FIG. 7, the upper die 109 is first positioned at a top dead center, and at that time the work W is placed on the lower die body 103 of the lower die 100. At this time, the rotary cam 102 has been rotated and withdrawn by the automatic return device 105.

Then, the upper die 109 starts to go down, and as shown in FIG. 8, first the bottom face of the slide cam 110 contacts the rotary plate 108 without the slide cam 110 interfering with the negative angle forming portion 104 of the rotary cam 102 and rotates the rotary cam 102 clockwise in FIG. 8.

When the upper die 109 still continues to go down, the slide cam 110 which is activated toward an outside of the die is moved to the left in the transverse direction by the action of the cam against the activating force of a coil spring 117 and reaches a state shown in FIG. 9, and thus the work W is negative angle-formed by the negative angle forming portion 104 of the rotated rotary cam 102 and the negative angle forming portion 112 of the slide cam 110.

After the negative angle forming, the upper die 109 starts to rise. The slide cam 110 has been activated toward an outside of the die by the coil spring 117 and moves right in FIG. 10 and still rises without interfering with the negative angle-formed work W.

While the restricting slide cam 110 rises, the rotary cam 102 is rotated counterclockwise in FIG. 10 by the automatic return device 105, and the work W can be taken out without interfering with the negative angle forming portion 104 of the rotary cam 102 when taking out the negative angle-formed work W from the lower die body 103.

As mentioned above, the thin plate forming parts nave been negative angle-formed using a rotary cam, and the rotary cam processes the work, rotating on its axis, thus viewing from the direction of processing, when the work is almost straight, the negative angle forming portion is housed in one rotary cam and can be processed. On the other hand when the work is bent, the negative angle forming portion can not be wholly housed in one rotary cam, and thus can not be processed.

In particular, sheet metal parts of an automobile including a door panel have many bent portions, moreover in recent years, have many negative angle-formed portions besides the bent portions due to the automobile's design. Therefore, it is desired that the negative angle formed portion can be formed in only one process without passing it through many processes, whereby the production efficiency is improved.

SUMMARY OF THE INVENTION

Then, in view of the above situation, the present invention is to provide a method of forming a sheet metal wherein in order to enable even a bent work to be negative angle-formed, the bent negative angle forming portion is formed by dividing it into plural forming portions so that they may become substantially straight within a range capable of processing with one rotary cam. A length of division of the bent negative angle forming portion is determined depending upon a range within which one rotary cam can cover the negative angle forming portion. When the coverage of the rotary cam is determined, the length of the rotary cam is naturally determined.

The present invention is also to provide a forming die for a thin plate wherein in order to enable even a bent work to be negative angle-formed, the bent negative angle forming portion is divided into plural forming portions so that they may become substantially straight within a range capable of processing with one rotary cam, and each divided portion is provided with a dedicated rotary cam and an automatic return device.

The present invention is further to provide a forming die for a thin plate wherein when a separately disposed rotary cam rotates in a junction portion with an adjacent rotary cam, they do not interfere with each other by shifting the timing of rotation, and work supporting portions and negative angle forming portions of the rotary cams are smoothly connected so that their shapes may conform with the shape of a finished part after the rotations of the cams. In addition, in the junction portion of the rotary cams, one rotation axis of one rotary cam intersects with the other rotation axis of the other rotary cam, thus in order to form a work into the finished part without deforming the work, the junction portions should be formed into shapes free of interference. In addition, forming the end of the rotary cam into a circular conical shape to prevent interference is not allowed because a gap is formed between both the rotary cams, and this causes deformation of the work at negative angle forming.

The present invention enables a bent work to be processed, with plural rotary cams, by one process in a manner that a negative angle forming portion of a work is bent when viewing a first die from a second die, and the negative angle forming portion of the bent work is divided into plural forming portions which are substantially straight within a range capable of processing with one rotary cam.

Furthermore, the present invention enables a bent work to be processed, with plural rotary cams, by one process in a manner that a negative angle forming portion of a work is bent when viewing a first die from a second die, and the negative angle forming portion of the bent work is divided into plural forming portions which are substantially straight within a range capable of processing with one rotary cam, and each divided portion is provided with a dedicated rotary cam and an automatic return device.

Still further, the present invention enables a bent work to be negative angle-formed with plural rotary cams in a manner that when a separately disposed rotary cam rotates in a junction portion with an adjacent rotary cam, they do not interfere with each other by shifting the timing of rotation, and work supporting portions and negative angle forming portions of the rotary cams are smoothly connected so that their shapes may conform with the shape of the finished part after the rotations of the cams. In addition, in the junction portion of the rotary cam, one rotation axis of one rotary cam intersects with the other rotation axis of the other rotary cam, thus in order to form the work into the finished part without deforming the work, the junction portions should be formed into shapes free of interference. In addition, forming the end of the rotary cam into a circular conical shape to prevent interference is not allowed because a gap is formed between both rotary cams, and this causes deformation of the work at negative angle forming.

DETAILED DESCRIPTION OF PREFERRED EMBODIMENTS

Figure 1:
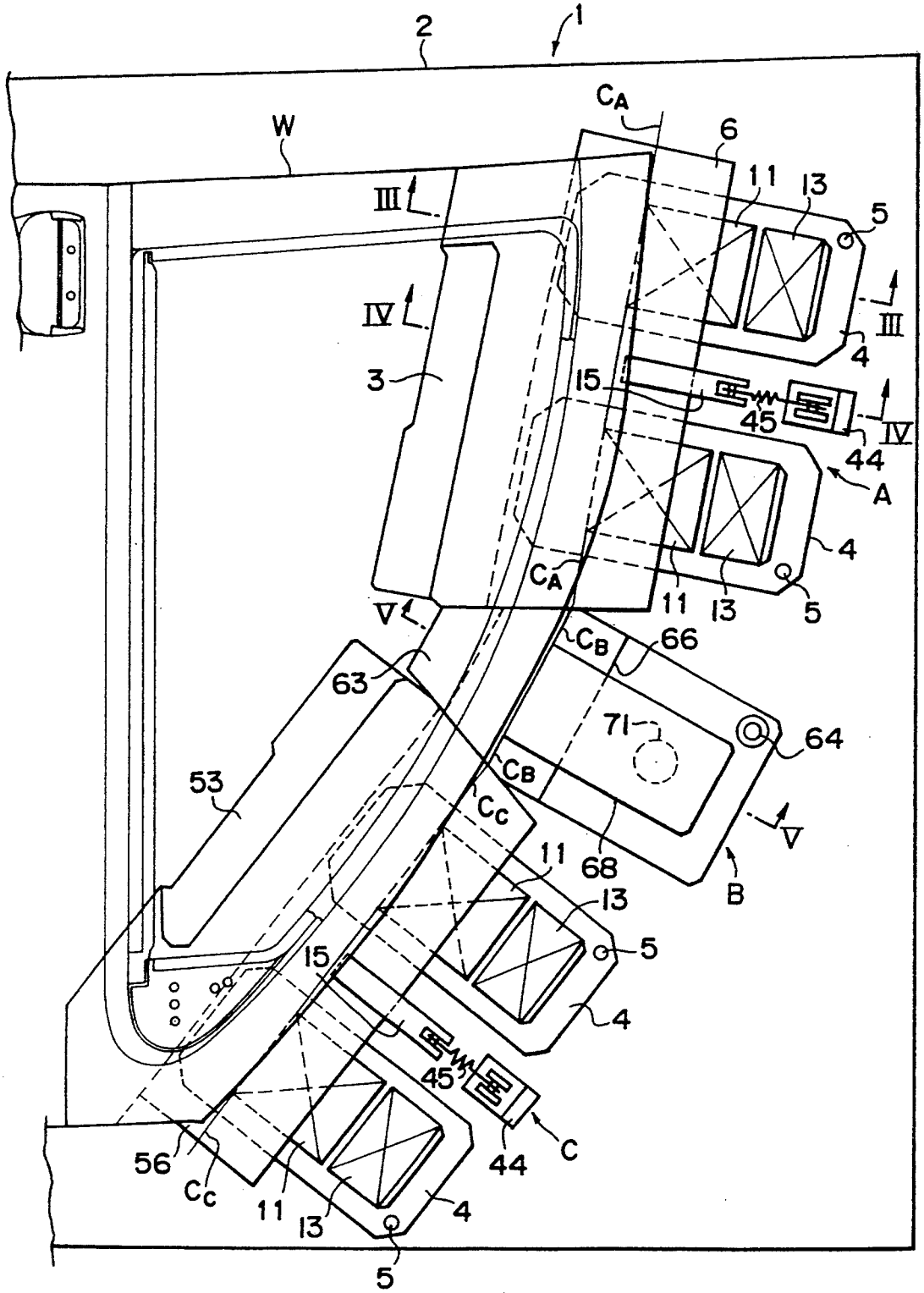
FIG. 1 is a plan view showing one concrete embodiment of the present invention.
Figure 2A:
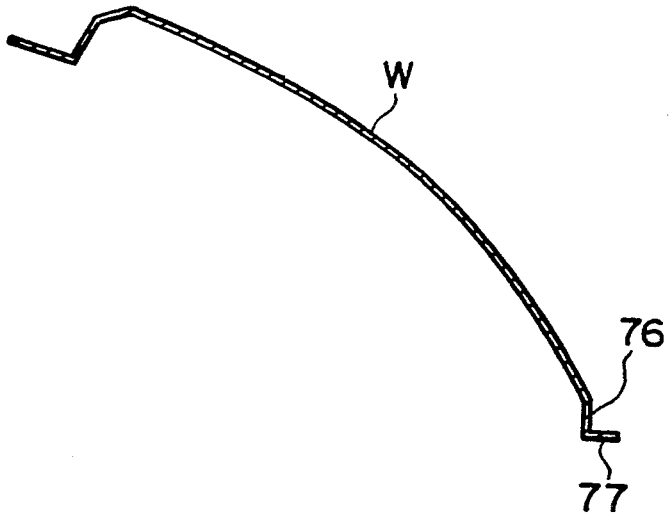
FIG. 2A shows a section of a work before the negative angle forming taken along line II—II of FIG. 1.
Figure 2B:
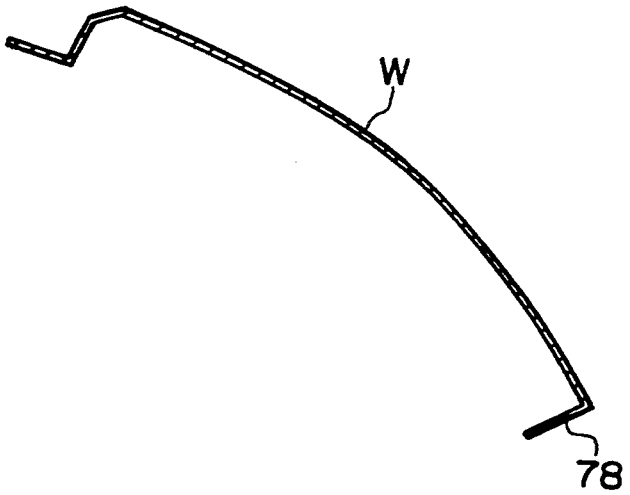
FIG. 2B shows a section of the work after the negative angle forming taken along line II—II of FIG. 1.

The present invention will be explained in detail on the basis of one concrete embodiment shown in FIGS. 1–5. A part formed by a forming die of the present invention is a front door outer of an automobile as shown in FIG. 1, that is, a circular arc portion of an upper part of the front door outer is so negative angle-formed that its section changes form the section shown in FIG. 2A to the section shown in FIG. 2B. A downward part 76 of a right-hand lower portion of the workpiece and an outward flange 77 adjacent to the downward part 76 shown in the figures are formed into an inward inclined part 78 which is directed diagonally inward. The circular arc portion of the upper part of the front door outer is considerably curved but a rotary cam rotates on an axis of rotation, and it is impossible to process the circular arc portion with one rotary cam because a negative angle forming portion can not be wholly housed into one rotary cam. Thus, the circular arc portion is divided into 3 parts so that they may become substantially straight within a range capable of processing with one rotary cam. That is, a part with a small radius of curvature in the center of the circular arc portion is divided as one part, and a total of three parts including both sides adjacent to this part are formed. Each of three separately disposed rotary cams can negative angle-form the circular arc portion.

FIG. 1 is a plan view, in the figure, a work W of an automobile's front door outer is placed in plan on lower die bodies 3, 53 and 63. The circular arc portion of the front door outer upper part is divided into three parts, and a cam B takes charge of the part with a small radius of curvature and a cam A and a cam C take charge of the parts with a large radius of curvature of the circular arc portion. In this case, the cams A and C have the same structure.

Figure 3:
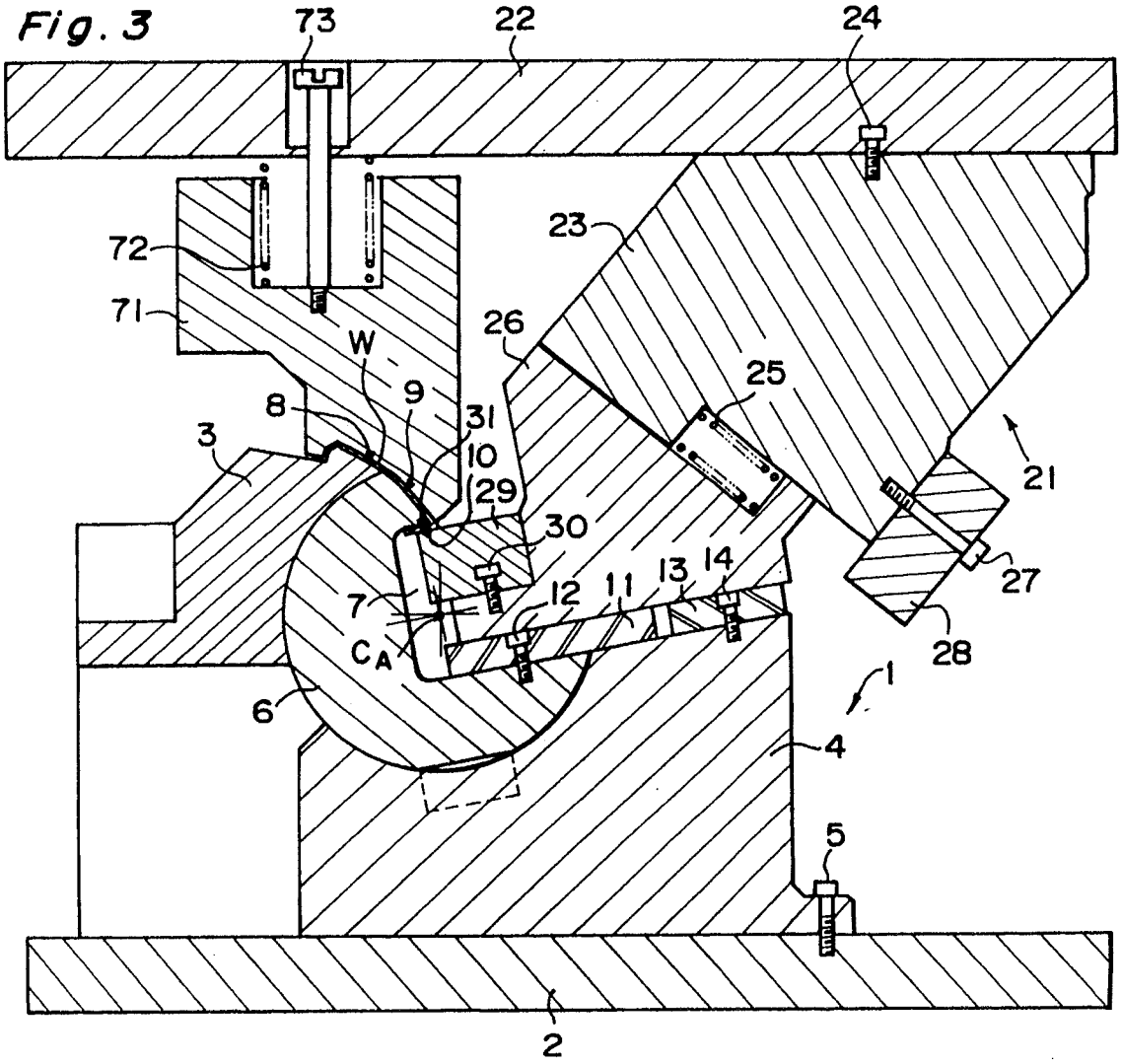
FIG. 3 is a longitudinal section view of FIG. 1 taken along line III—III of FIG. 1.
Figure 4:
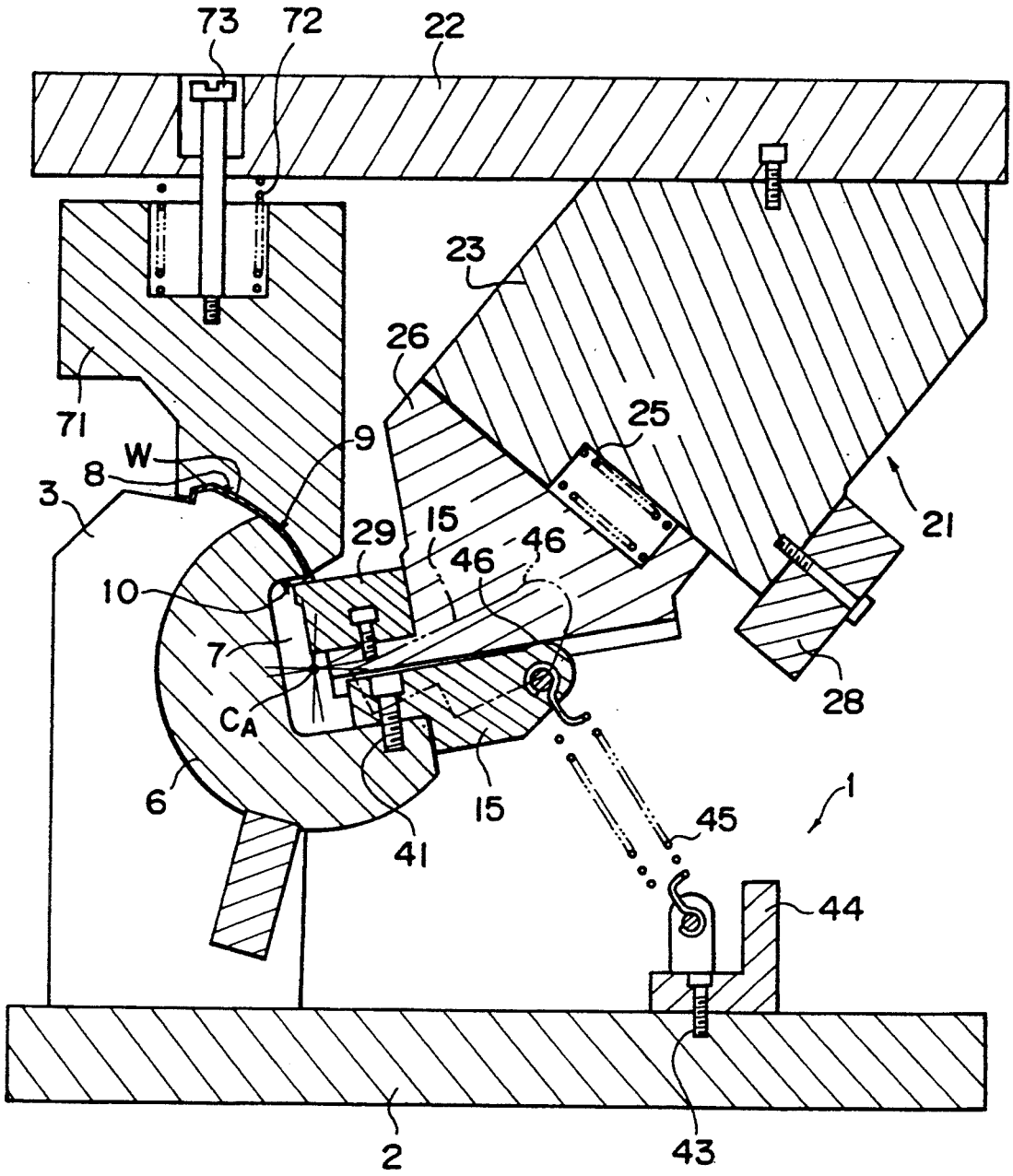
FIG. 4 is a longitudinal section view of FIG. 1 taken along line IV—IV of FIG. 1.

The cam A is shown in FIGS. 1, 3 and 4. A lower die 1 is provided with, on a lower base 2, a lower die body 3 on which a work W is placed. Supporting blocks 4 which support rotary cams 6 and 56 are fixed with bolts 5 on the lower base 2, and rotatably support the rotary cam 6 between the supporting blocks 4 and the lower die body 3.

The rotary cam 6 is formed into a circular cylinder around a rotation axis $C_A$, and is provided with an open receiving slot 7 which receives a slide cam 26 described later. The upper portion of the supporting block 4 and the side portion of the lower die body 3 are supporting portions for the rotary cam 6 and are formed into circular arc faces so as to support the rotary cam 6. The upper portion of the lower die body 3 is formed into a work placing portion 8 having the same shape as the work W so as to support the work W, and the portion of the rotary cam 6 continuing from the work placing portion 8 of the lower die body 3 is formed into a work supporting portion 9 having the same shape as the work W. The work placing portion 8 and the work supporting portion 9 are formed into the same shape as that of a finished part so as not to deform the work at negative angle forming. One side face of the rotary cam 6 receiving slot 7 near the work supporting portion 9 is formed into a negative angle forming portion 10. In addition, on the other side face of the receiving slot 7, a rotary plate 11 is fixed with a bolt 12. A near plate 13 is fixed with a bolt 14 on the upper face of the supporting block 4 outside the rotary plate 11 in order to guide a slide cam described later.

As shown in FIG. 1, in the cam A, the rotary cam 6 is supported at its both ends by the supporting blocks 4, and a timing plate 15 is provided between the supporting blocks 4 which adjusts timing of cam rotation to the cam B's and the cam C's rotations as shown in FIG. 4.

While, in an upper die 21, an inclined guide 23 is fixed on an upper base 22 with a bolt 24, and on the bottom face of the inclined guide 23, a slide cam 26 which is activated toward an outside of the die by a coil spring 25 is guided (not shown) and slidably equipped. The slide cam 26 is stopped by a stopping plate 28 fixed with a bolt 27 to the lower end of the inclined guide 23.

A negative angle forming member 29 is fixed to a bolt 30 in a slide cam 26 lower position opposed to the receiving slot 7 of the rotary cam 6, and a negative angle forming portion 31 is formed on the top face of the negative angle forming member 29.

As shown in FIG. 4, the base end of the timing plate 15 is fixed with a bolt 41 to the side face of the receiving slot 7 lower side of the rotary cam 6, and the end of the timing plate 15 is provided with a push spring 45 connected to a bracket 44 which is fixed with a bolt 43 to the lower base 2. When the push spring 45 is not pushed by the slide cam 26, the timing plate 15 rotates to become a state shown with a two-dotted chain line and the rotary cam 6 also rotates and thus the timing plate 15 withdraws and rotates the rotary cam 6 so that a negative angle-formed work W can be removed from the lower die body 3.

When the bottom face of the slide cam 26 contacts the end 46 of the timing plate 15, the rotary cam 6 starts to rotate. Therefore, timing of rotation of the rotary cam 6 is determined depending upon a distance from the rotation axis $C_A$ of the rotary cam 6 to the end 46 of the timing plate 15. That is, as the distance from the rotation axis $C_A$ of the rotary cam 6 to the end 46 of the timing plate 15 becomes longer, the rotary cam 6 rotates faster, and as the distance becomes shorter, the rotary cam 6 rotates slower.

The cam C, whose section is not shown, has the same structure as the cam A, and the rotary cam 56 having its rotation axis $C_C$ is rotatably disposed between the supporting blocks 4 and the lower die body 53. The rotary cam 56 is rotatably mounted between the two supporting blocks 4 and provided with the same timing plate 15 as that of the cam A between the blocks 4 and rotates with the same timing as the cam A.

In the present forming die, also before negative angle forming, the work is strongly pushed against the lower die body 3, 53 and 63 by a pad 71, and then negative angle-formed in the same way as a conventional technology. The pad 71 is activated downward by a coil spring 72 and is hung from the upper base 22 by a bolt 73.

Figure 5:
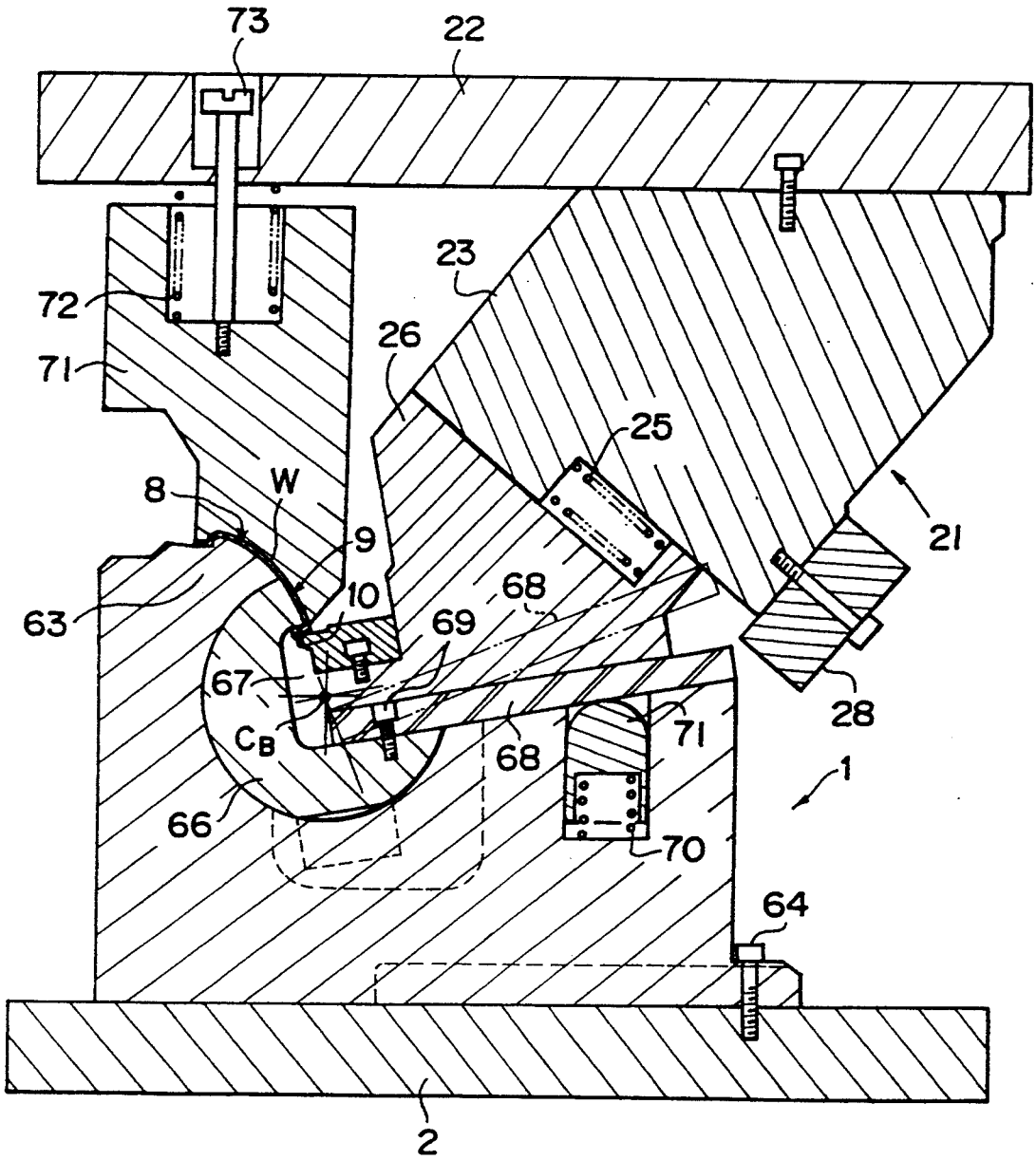
FIG. 5 is a longitudinal section view of FIG. 1 taken along line V—V of FIG. 1.
Figure 6:
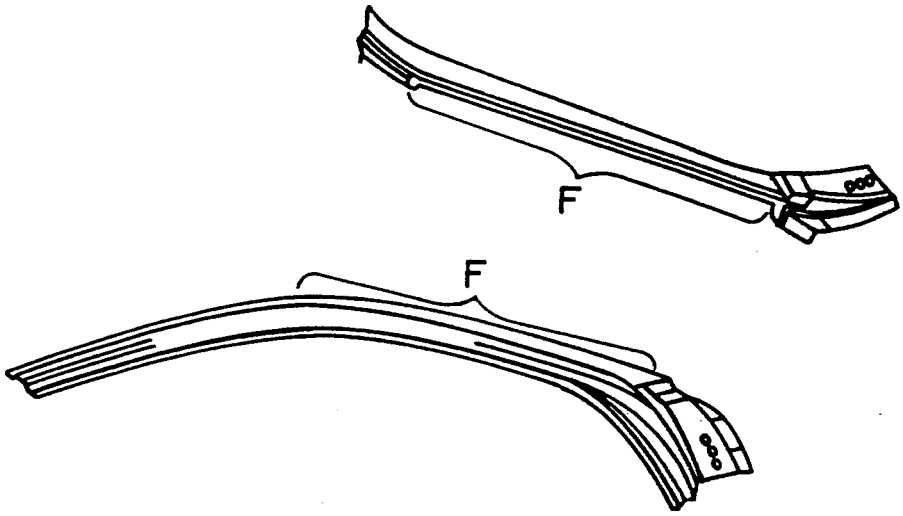
FIG. 6 is a schematic perspective view showing finished right and left parts of front pillar outer of the automobile's sheet metal parts.
Figure 7:
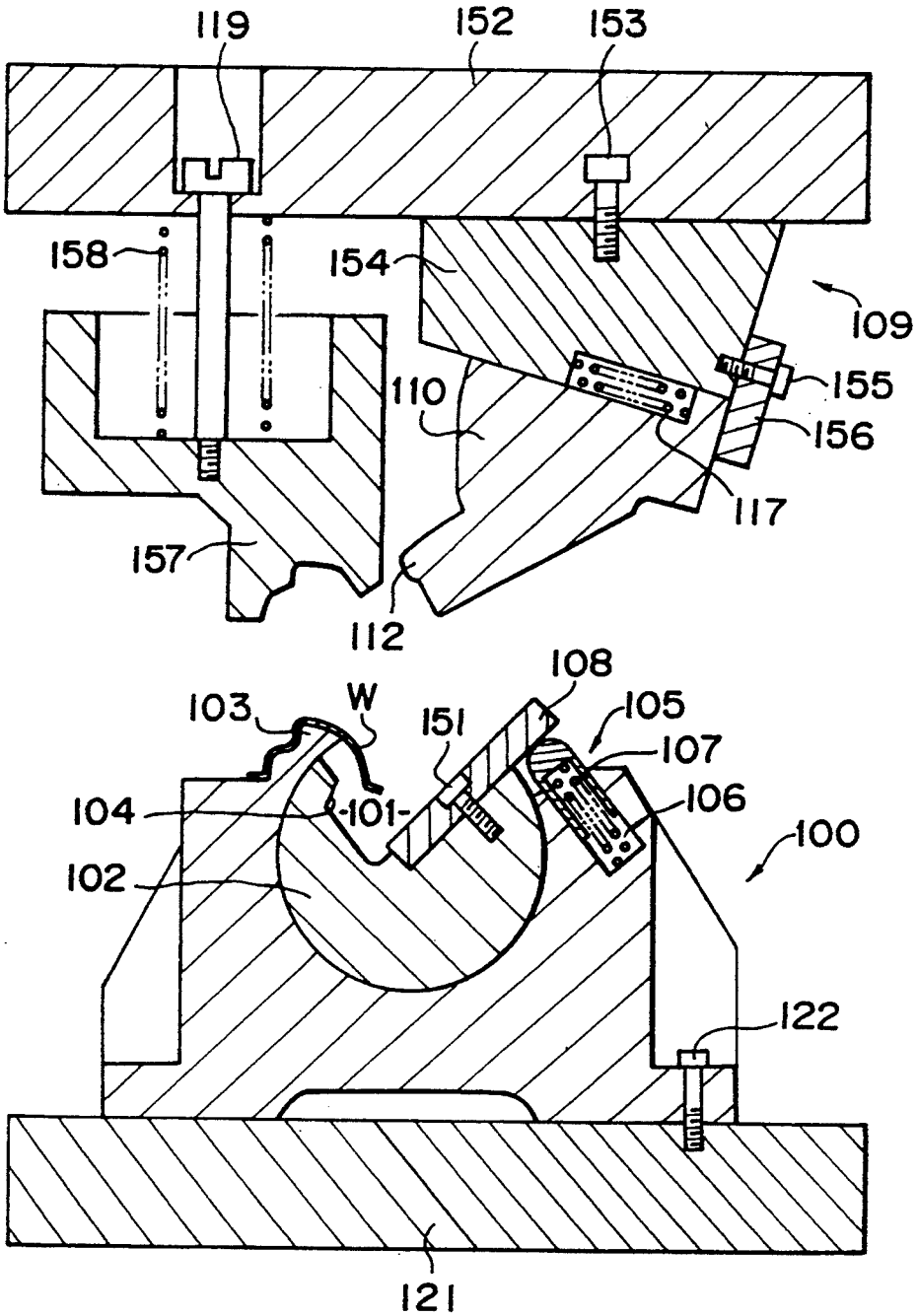
FIG. 7 is a longitudinal section view showing an upper die, at its top dead center, of a forming die for negative angle-forming the front pillar outer of FIG. 6.
Figure 8:
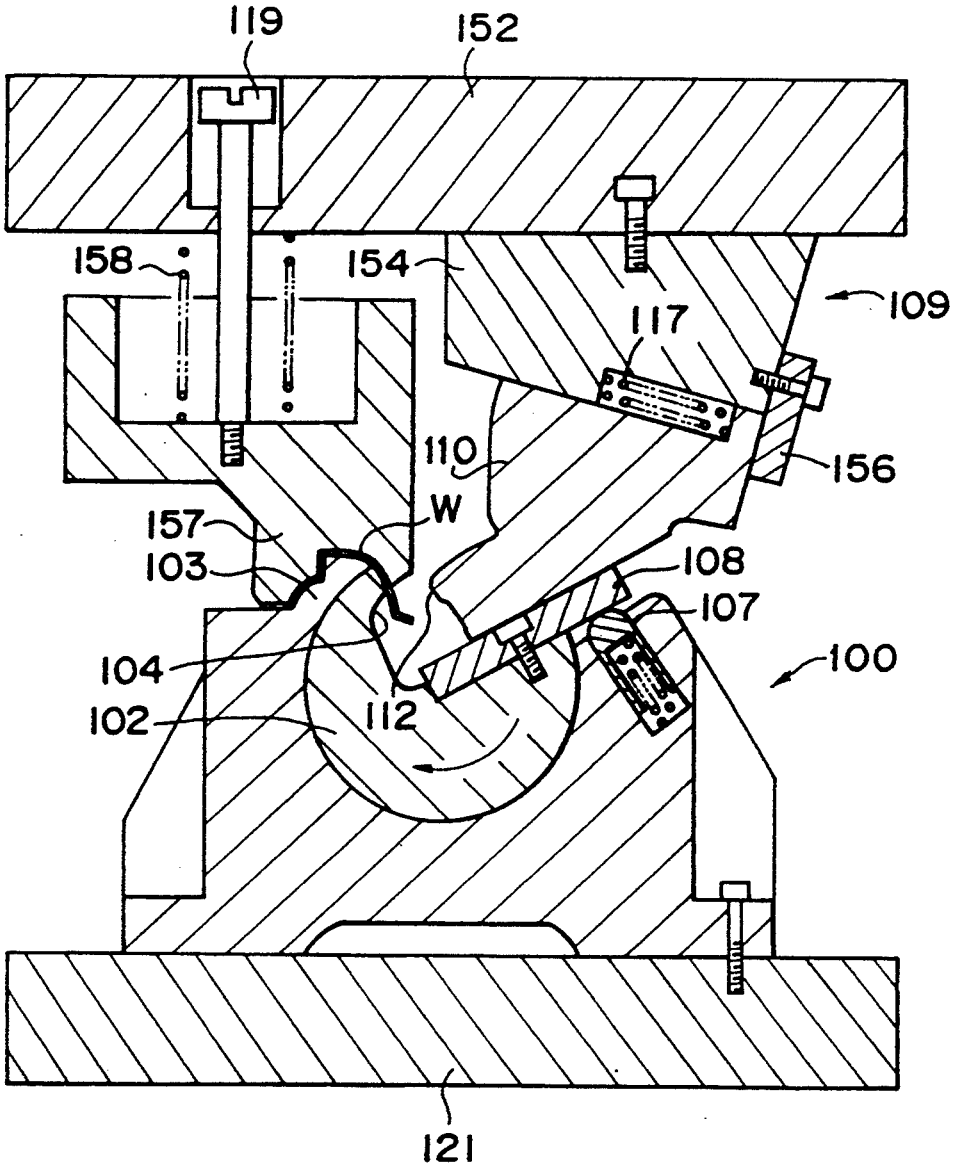
FIG. 8 is a longitudinal section view showing a state wherein the upper die of the forming die of FIG. 7 goes down and contacts with the lower die.
Figure 9:
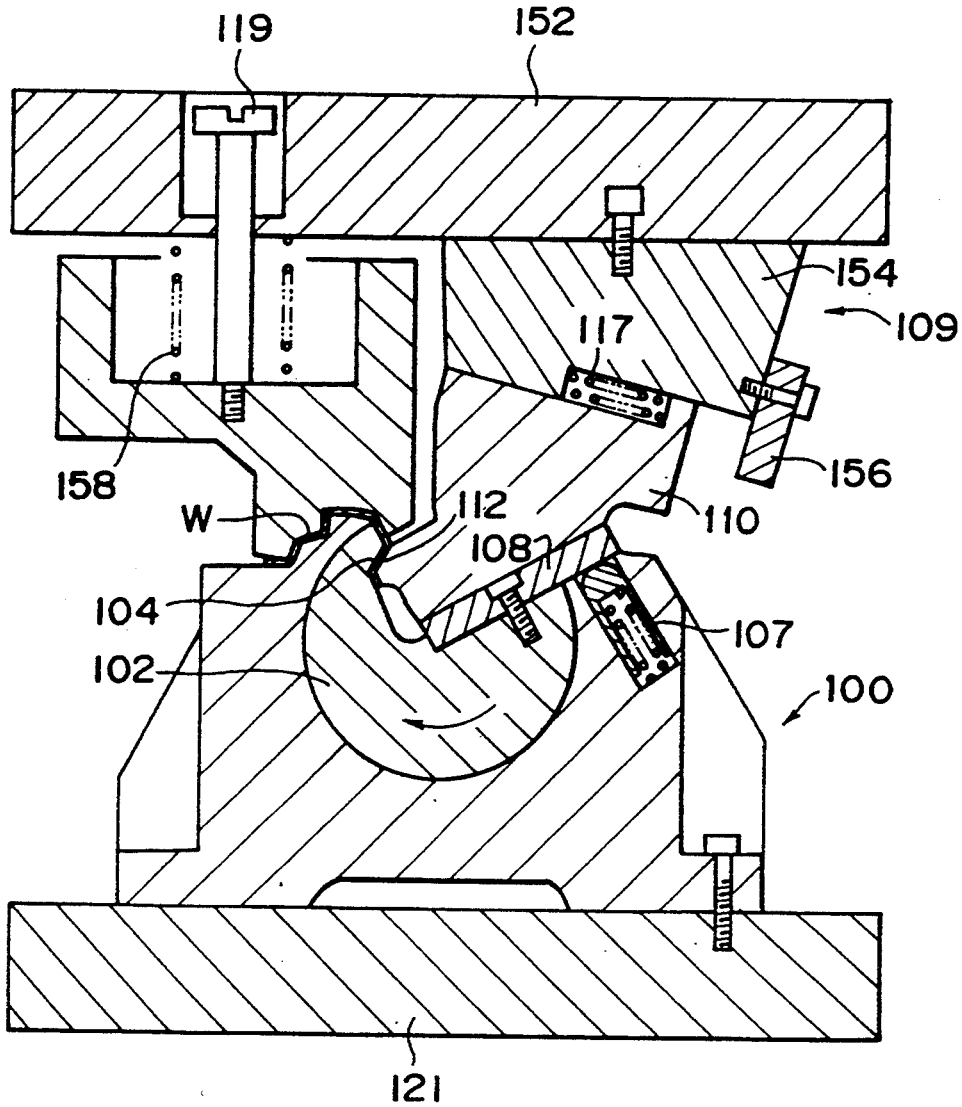
FIG. 9 is a longitudinal section view showing a state wherein the upper die of the forming die of FIG. 7 is at its bottom dead center.
Figure 10:
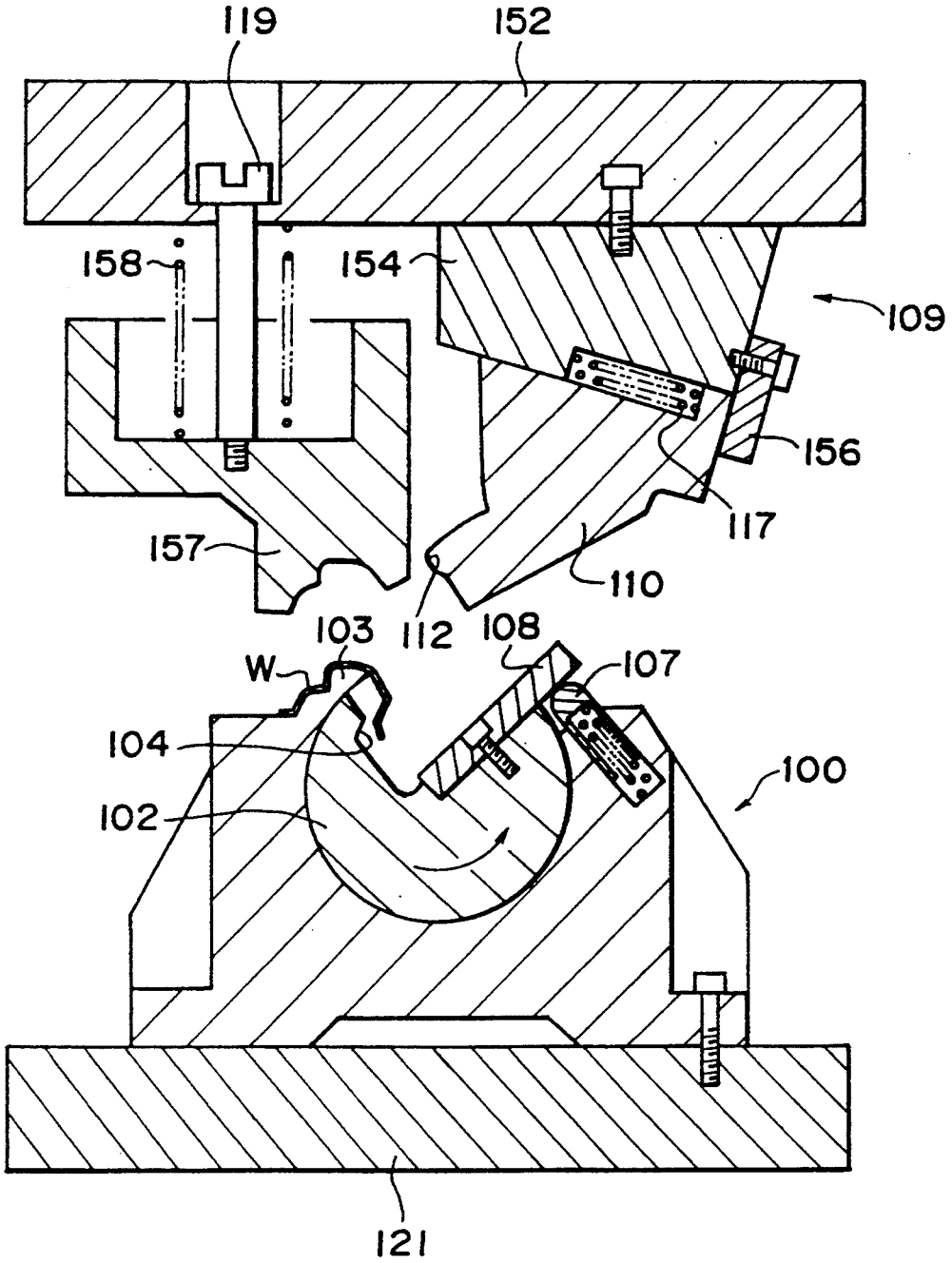
FIG. 10 is a longitudinal section view showing a state wherein after the negative angle forming of the forming die of FIG. 7, the upper die goes up and reaches the top dead center.

Next, the cam B is shown in FIG. 5.

The lower die body 63 is fixed with a bolt 64 to the lower base 2, and the rotary cam 66 having its rotation axis $C_B$ is rotatably disposed in the center upper portion of the lower die body 63. The timing plate 68 is fixed with a bolt 69 on a lower side face of the receiving slot 67 of the rotary cam 66, and a push pin 71, which is buried in the lower die body 63 and activated by a coil spring 70, makes the timing plate 68 rotate and also makes the rotary cam 66 rotate, thereby enabling removal of a negative angle-formed work W from the lower die body 63.

As mentioned above, the automatic return device of the rotary cam 66 of the cam B employs a system different from the automatic return devices of cam A and cam C, and in this case the return device is set to rotate the cam with delay from the cam A and the cam C. Therefore, a work W of an automobile's front door outer is placed on the lower die body 3, 53, and 63, then the upper die 21 goes down and the slide cam 26 contacts the timing plate 15 to rotate the rotary cams 6 and 56 and wait for the negative angle forming, and thereafter the rotary cam 66 of the cam B rotates and waits for the negative angle forming.

In such a standby state, the work supporting portions 9 and the negative angle forming portions 10 of the cam A, cam C and the cam B are so set that they are smoothly connected with that of the adjacent cams to form the shape of the finished part. If they are not so connected as to form the shape of the finished part, the work deforms when negative angle-formed. Furthermore, the work placing portion 8 of the lower die body 3 and the work supporting portions 9 and the negative angle forming portions 10 of the rotary cam 6, rotary cam 56, and rotary cam 66 are set so that they are smoothly connected to form the shape of the finished part in order to prevent deformation of the work W, and at the same time the end connecting portions of the rotary cams 6, 56, and 66 are so set so that they are formed into suitable shapes to prevent interference between them when the rotary cams rotate.

The pad 71 strongly pushes the work W on the work supporting portions 9 of the lower die bodies 3, 53 and 63 and the rotary cams 6, 56 and 66, and the negative angle forming portions 10 of the rotary cams 6, 56 and 66 and the negative angle forming portions 31 of the slide cams 26 perform negative angle forming of the work therebetween, thereafter the upper die 21 rises and the slide cams 25 move toward an outside of the die due to activation by the coil springs 25, and this prevents interference between the negative angle forming portions 10 of the rotary cams 6, 56 and 66 and the negative angle forming portions 31 of the slide cams 26. And when the upper die 21 continues to rise, the timing plate 15 and the push pin 71 also rise due to activation of the push spring 45 and the coil spring 70 to make the rotary cams 6, 56 and 66 withdraw and rotate, and this enables the work W to be taken out from the lower die bodies 3, 53 and 63.

In the above embodiment, the cam A and the cam C are made to have the same timing, while the timing of the cam B is delayed. The timing can be changed depending upon the work, and means for shifting timing is easily realized by other mechanisms besides the above example of the embodiment.

EFFECTS OF THE INVENTION

The present invention enables a bent work to be processed, with plural rotary cams, by one process in such a manner that a negative angle forming portion of a work is bent when viewing a fist die from a second die, and the negative angle forming portion of the bent work is divided into plural forming portions which are substantially straight within a range capable of processing with one rotary cam.

Furthermore, the present invention enables a bent work to be processed by one process in a manner that a negative angle forming portion of a work is bent viewing a first die from a second die, and the negative angle forming portion of the bent work is divided into plural forming portions which are substantially straight within a range capable of processing with one rotary cam, and each divided portion is provided with a dedicated rotary cam and an automatic return device.

Still furthermore, the present invention enables a bent work to be negative angle-formed in a manner that when a separately disposed rotary cam rotates in a junction portion with an adjacent rotary cam, they do not interfere with each other by shifting the timing of rotation, and work supporting portions and negative angle forming portions of the rotary cams are smoothly connected so that their shapes may conform with the shape of a finished part after the rotations of the cams.

What is claimed is:

1. A forming die for a thin plate which produces a negative angle formed portion piece of work comprising:

a first die rotatably provided with a cylindrical rotary cam with an axially engraved slot, said slot having a slot edge;

a negative angle forming portion formed on the slot edge of the rotary cam;

a second die equipped with a slide cam having a negative angle forming portion opposing said rotary cam, the slide cam being activated toward an outside of the die and slidably equipped;

a pad activated toward the first die and hung from the second die;

an automatic return device further provided on said first die which rotates and withdraws the rotary cam to the extent that after forming, the work can be taken out from the first die;

further rotary cams each having a slot edge with a negative angle forming portion and automatic return devices in a manner that the negative angle forming portion of the work is bent toward the first die;

the negative angle forming portion of the bent work being divided into plural forming portions which are substantially straight within a range capable of processing with one rotary cam wherein a dedicated rotary cam provided for each divided portion;

an automatic return device provided in connection with each dedicated rotary cam; and a timing plate fixed to the side face of a receiving slot lower side of each rotary cam, wherein when each separately disposed rotary cam rotates in a junction portion with an adjacent rotary cam, interference does not occur by shifting the timing of rotation, and work supporting portions and negative angle forming portions of the rotary cams are smoothly connected so that their shapes may conform with the shape of a product after the rotations of the cams.

2. A forming die for a thin plate comprising:

opposing upper and lower bases;

first and second pairs of supporting blocks mounted on the lower base;

first and second rotary cams rotatably mounted within said first and second pairs of supporting blocks, respectively;

first and second lower die bodies mating with said first and second rotary cams, respectively;

a third lower die body positioned between said first and second lower die bodies;

a third rotary cam rotatably mounted on said third lower die;

an upper die portion provided in connection with the upper base;

first negative angle forming portions provided on each of said rotary cams, respectively;

a slide cam provided in connection with said upper die, wherein said slide cam includes a second negative angle forming portion engageable with said first negative angle forming portions; and means for independently actuating each of said first, second and third rotary cams for selectively engaging said first negative angle forming portions with said second negative angle forming portion.

* * * * *